United States Patent [19]

Herman

[11] 4,356,642

[45] Nov. 2, 1982

[54] SUPPORT DEVICE

[76] Inventor: Shephard Herman, 12 Radcliffe Rd., Newton, Mass. 02168

[21] Appl. No.: 181,880

[22] Filed: Aug. 27, 1980

[51] Int. Cl.[3] ..... A43B 13/38; B32B 5/18

[52] U.S. Cl. ..... 36/44; 428/178; 428/518; 428/520; 428/215; 428/424.7; 428/317.1

[58] Field of Search ..... 428/178, 215, 311, 315, 428/322, 424.7, 518, 520; 36/44

[56] References Cited

U.S. PATENT DOCUMENTS

| | | | |
|---|---|---|---|
| 3,170,250 | 2/1965 | Scholl | 36/44 |
| 3,548,420 | 12/1970 | Spence | 36/44 X |
| 3,589,037 | 6/1971 | Gallagher | 36/44 |
| 3,746,604 | 7/1973 | Reynolds | 428/322 X |
| 4,099,342 | 7/1978 | Singh | 428/317 |

*Primary Examiner*—P. Ives

*Attorney, Agent, or Firm*—Dike, Bronstein, Roberts, Cushman & Pfund

[57] ABSTRACT

A support device as disclosed, such as for use as an innersole for footwear, which provides cushioned support conforming to the shape of the wearer's foot to distribute the weight of the wearer substantially evenly over the supported area. At least one air cushion layer comprising closely spaced, discrete air pockets entrapped between plastic film is adhered to a layer of soft, flexible, open cell foam. A pressure sensitive adhesive is used which impregnates the foam layer and, when in use under pressure, coats the plastic film, thereby reinforcing it against leakage or rupture and conforming it semi-permanently in the pressure-distorted shape. Protective sheathing may be used, adhered to the outer surface of the air pocket layer by pressure sensitive adhesive.

14 Claims, 4 Drawing Figures

SUPPORT DEVICE

INTRODUCTION

Field of the Invention

This invention relates to a cushioned innersole device and more specifically to a device of laminar construction which provides cushioned support and which conforms to the shape of the wearer's foot.

BACKGROUND OF THE INVENTION

Various physical disorders, especially foot, leg, and back disorders, require the afflicted person to avoid or to minimize pressure upon the foot, particularly the heel of the foot. Often considerable pain will result from activities such as running or jogging and for some even prolonged walking or standing is intolerable. Proper cushioning of the foot will provide relief for many such afflicted persons. Support innersoles of various designs such as those which can be inserted into routine footwear, have been proposed, but have been found to be unsatisfactory. To be effective, a device generally must provide a cushion to the supported area, that is, the portion of the foot overlying the device. It must be neither unyielding, nor so easily compressed that it fails to absorb the shock of walking or running. Rather, an effective device must provide an intermediate resistance to compression, that is, it most provide cushion to both absorb shock and to distribute the weight of the wearer over the supported area.

Not only must the device provide effective cushion, it must also be durable. Present support innersoles which do provide some degree of cushion, often rapidly "buttom-out", that is they become permanently compressed after a short period of use and thereafter provide little or no cushion. This is often the case with closed-cell foams. Sponge rubber and like materials are known which are resilient and do not bottom-out, even after repeated use, but such materials offer no significant resistance to compression and thus, in use, provide substantially no cushion.

Not only is suitable compressive resistance needed to provide proper cushioning, and resiliance needed to avoid rapid bottoming-out but also, most advantageously, an effective device should have the ability to adequately conform itself to the shape of the foot such that the wearer's weight can be distributed substantially evenly over the entire support area.

It is the principle object of the present invention to provide relief from physical disorders which require cushioned support for the foot. More specifically, it is an object of the present invention to provide an innersole support device which will provide cushioned support for the wearer.

It is a further object of the present invention to provide a support device which does not quickly bottom-out, yet which has suitable resistance to compression to provide proper cushion while in use.

It is another object of the present invention to provide a support device which can conform itself to the shape of the foot to distribute the weight of the wearer substantially evenly over the entire supported area.

SUMMARY OF THE INVENTION

Accordingly a support device of laminar construction has now been invented which comprises a layer of flexible open-cell foam, at least one and preferably two layers comprising air pockets entrapped between flexible plastic film, which air-cushion layer is coated with a reinforcing adhesive layer, preferably comprising a pressure sensitive latex adhesive, and preferably a protective outer sheathing. The device can either be an integral portion of the innersole of the footwear itself, or a separate, supplementary, insertable device.

The support device of the present invention has been found to provide a significant unexpected advantage in that it conforms with use, to the shape of the wearer's foot. Moreover, it is additionally advantageous in that it does not bottom-out or fail to cushion after taking the conforming shape, but rather continues to provide a cushion over the entire support area. This is highly advantageous in view of the obvious importance not only to provide cushion for the foot, but also to distribute the weight of the wearer as evenly as possible over as much as possible of the support area. Thus, the present invention, providing durable cushioning due to its extreme resistance to bottoming-out, and having in conjunction therewith the ability to conform to shape, can provide effective and long-term relief to those persons suffering physical disorders requiring the alleviation of pressures on the foot.

DETAILED DESCRIPTION OF THE INVENTION

Figure 1:
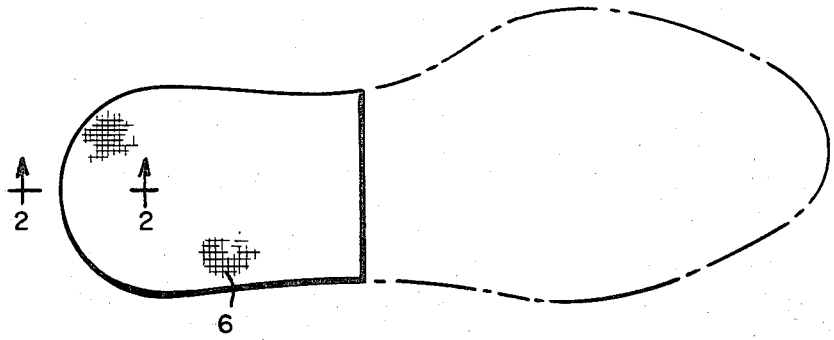
FIG. 1 is a plan view of an exemplary support device according to the present invention.

Referring to the drawings, the support device of the present invention comprises at least one layer of relatively small, closely spaced air pockets. Each air pockets 1, or air bubbles, is entrapped between flexible plastic film 2 and provides, in effect, a cushion of air. The plastic film may comprise any flexible material of sufficient strength such a polyethylene or preferably polyvinyl film. The film thickness can vary; thicker films giving greater durability. A thickness of about one to three mils has been found suitable.

The term air is used to mean either air or any suitable gas compatible with the plastic film. The air cushion layer can be formed in any suitable manner, such as by the known vacuum forming processes in which a flexible plastic film is laminated to one side of a second such film lying on a mold with which closely spaced by discrete concavities are formed by applying heat and vacuum. The air occupying the concavity is trapped inside forming air pockets in the approximate form of a half sphere.

The range of suitable air pocket size cannot be sharply defined, and is dependent in part on such factors as the weight of the user. In the case of air pockets formed by said vacuum forming process, for persons of average weight, for use in routine activities such as walking, the preferred size is from about $\frac{1}{8}$ to $\frac{1}{2}$ inch diameter and most preferably about $\frac{1}{4}$ inch diameter. Smaller air pockets provide less cushion and those larger are more prone to rupturing. The preferred size of about $\frac{1}{8}$ to $\frac{1}{2}$ inch diameter and most preferred size of about $\frac{1}{4}$ inch refers to the diameter of the diameter of the circle at the base of the half sphere. The resultant air pocket volume is from about 0.005 to 0.25 cubic inches and about 0.03 cubic inches, respectively. Where the air pockets do not have the shape of a half-sphere, the size should be chosen to fall within such volume range. Space is provided between adjacent air pockets and, while not intending to be bound by theory, it is believed that upon the application of force perpendicular to the plane of the air cushion layer, supportive cushioning is provided both by the compression of the entrapped air and by the elastic deformation of the individual air pockets into the space surrounding each.

The pressures encountered in normal use are sufficient to cause the air pockets to leak or even rupture. Moreover, referring again to FIG. 2, it can be seen that a crease 3 is formed at the base of each half-sphere, which crease is believed to be especially vulnerable to air-leakage and to rupture. Excessive air leakage and/or ruptured air pockets would cause the device to bottom out. According to a novel and important aspect of the present invention, however, both leakage and rupturing are significantly reduced or eliminated by providing a flexible, adhesive coating to reinforce the air cushion sheet. Thus strengthened, the air cushion sheet of the present invention contributes both proper resistance to compressive force to provide cushioned support to the wearer, and good resistance to bottom-out, even after a considerable period of use.

To ensure effectiveness, there must be good coverage and adhesion of the adhesive coating to the plastic film, especially in the crease at the base of the half sphere. To achieve this important advantage, the air cushion sheet is laminated to a sheet 4 of flexible, easily compressable, open-cell foam. While various suitable foams are known to the skilled in the art, polyurethane foam has been found both suitable and readily commercially available. The use of the open cell foam is a novel and significant aspect of the present invention. Since the foam is soft and flexible, it conforms under pressure in use to the surface of the air cushion sheet. Under pressure, the foam follows the surface of the individual air pockets and substantially fills any space which is between them. While not wishing to be bound by theory, the present understanding is that the laminating adhesive layer 5, impregnates the open cell foam and, when subsequently in use under pressure, flows out to form a reinforcing coating over substantially the entire surface of the air cushion layer. The foam, being soft and flexible, is forced into the spaces between the air pockets and thereby carries the adhesive even to the crease at the base of substantially every air pocket.

Figure 2:
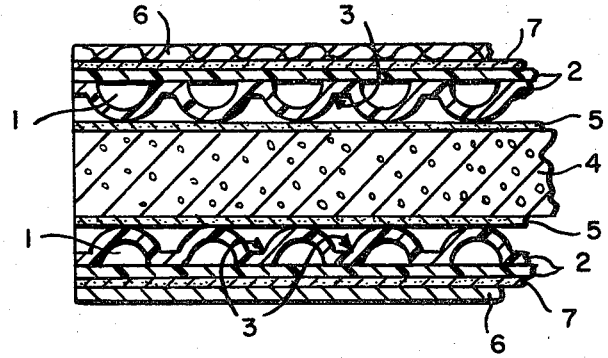
FIG. 2 is a sectional view taken along line 2—2 of FIG. 1, of the support device prior to application of compressive pressure.

The foam thickness is not critical within the preferred range of about $\frac{1}{8}$ to $\frac{1}{2}$ inch thick, preferably increasing with the diameter of the air pockets. Most preferably, the thickness of the foam is about one quarter inch, or thicker if necessary to permit the foam to conform to the surface of the air pockets. In the most preferred embodiment, one air cushion layer is adhered to each side of the foam. The foam used in that instance is preferably sufficiently thick to conform to the adjacent surface of the air pockets on both sides. Where the air cushion layer comprises air pockets in a shape such as a half-sphere, the foam should be laminated to the bubbled side of the air cushion layer, as illustrated in FIG. 2. This will permit the foam to conform to the irregular surface of the air pockets which results when pressure is applied to the support device. This in turn will permit the foam to carry the adhesive to the crease at the base of the half-sphere where it can flow out to form the reinforcing coating.

Figure 3:
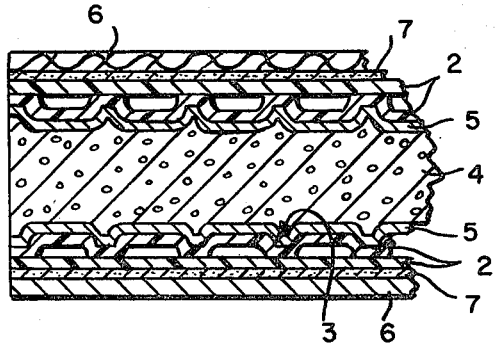
FIG. 3 is the same sectional view as in FIG. 2, showing the support device after application of compressive pressure.

FIG. 3 shows schematically a support device of the present invention after the application of compressive pressure. The air pockets 1 have deformed. Foam layer 4 has conformed to the irregular surface of the air pocket layers, thereby carrying adhesive layer 5 to the surface of the air pocket layer, including the crease 3 at the base of the plastic film 2 which entraps the air pockets.

A suitable type and amount of adhesive must be employed which will flow sufficiently to impregnate the open cell foam and, in use under pressure, flow out to coat the air cushion layer. Adhesives of the pressure sensitive type, not subject to either embrittlement or dry-out are most suitable. The amount employed is not critical within the suitable range and can easily be determined empiracally. It has been found that about one to five mils is suitable. Preferably, a rubber-based latex adhesive with an organic solvent base, such as a slow-drying solvent, e.g., toluene, is used. A preferred adhesive material is Industrial Adhesive Serial No. 6488, manufactured by U.S. Rubber Co., Mishawaka, Ind.

The support device of the present invention is uniquely advantageous in that it not only provides cushion, but rather also closely conforms after a short period of use to the shape of the wearer's foot while yet providing cushion at each point. Moreover, once having conformed to the given shape, the support device will substantially retain that shape even when not in use for considerable periods of time. While not wishing to be bound by theory, it appears that the air cushion layer responds to the pressures exerted during use both by overall bonding, since it is flexible, and by semi-elastic deformation of the shape of the air pockets. The foam, being soft and flexible, conforms to the surface of the pressure-deformed air cushion layer. The use of an adhesive which is able to impregnate the foam, be carried by it the surface of the pressure-deformed air cushion layer(s) and there flow sufficiently to coat that surface, results, in effect, in an in-situ lamination of the air cushion sheet in the desired shape. The adhesive lamination thereafter acts to maintain that desired shape. The unique construction of the support device of the present invention thus provides both cushion, which is not subject to rapidly bottoming-out, and shape conformity to provide cushion at each portion of the supported area. The result is substantially uniform distribution of the weight of that wearer and, consequently, comfort and relief from those physical disorders which require the distribution or minimization of pressures placed on the foot.

Preferably, the support innersole is provided with a protective sheathing 6. The sheathing can comprise any sufficiently flexible, and smooth material. Preferably the material is suitable for use in direct contact with the foot of the wearer. Kraft board has been found to be sufficiently durable and is preferred for use as the sheathing on the downward, or shoe-side, of the support innersole. Cloth, such as preferably bias binding or other somewhat stretchable cloth is suitable for use as the sheathing on the upward or foot-side of the support innersole. Other suitable materials are known to the skilled in the art. The sheathing is laminated to the outward, generally flat side of the air cushion layer(s)

by a layer of adhesive 7. The adhesive used is preferably the same as that already described for the lamination of the air cushion layer to the foam layer. The adhesive coating on the outer side of the air cushion layer completes the reinforcing coating to prevent leakage and rupture. That is, together with the adhesive on the inward side of the air cushion layer, which in use under pressure is forced into intimate, adhesive contact with substantially the entire inner surface of the air cushion layer, it provides flexible, resilient reinforcement to the air pocket layer such that the support device of the present invention can provide proper cushioned support with good resistance to bottoming-out.

Similar sheathing material, such as cloth, can be used for the perimeter of the device. Which perimeter sheathing can be applied in any suitable manner such as those known to the art. It may, for example, be sewn to the device. Adhesive may also be employed.

In a preferred embodiment, the protective sheathing comprises a continuous outer casing of a suitable, preferably plastic material. This outer casing is preferably airtight and is most preferably a heat sealed layer of polyvinyl or other suitable plastic totally encasing the cushion device. The outer casing acts to further protect against air escape from the device and thus acts to further protect against bottoming-out. Where an outer casing is employed, some or all of the protective sheathing described above can be deleted. Such protective sheathing need not be sewn or otherwise adhered to the device if an outer casing of heat sealed plastic is to be applied.

Figure 4:
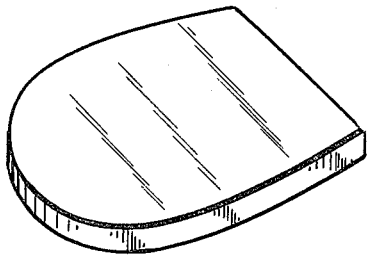
FIG. 4 is an isometric view of the cushion device of the present invention wherein the protective outer sheathing comprises a continuous outer casing.

FIG. 4 shows a preferred embodiment of the device of the present invention wherein the protective sheathing comprises a continuous outer casing.

It should be understood that the present disclosure is for the purpose of illustration only and includes all modification or improvements which fall within the scope of the claims. In particular, the present support device is useful in application other than as a cushioned support innersole in footwear and such use is within the present invention.

What is claimed is:

1. A support device resistant to bottoming out of laminar construction comprising:
   - a layer of flexible, open cell foam;
   - at least one air pocket layer over said open cell foam comprising air pockets entrapped between impervious flexible plastic film and said open cell foam; and
   - a layer of adhesion between said foam and said air pocket layer, binding said foam to said air pocket layer;
   - whereby, during use, the foam will conform to the surface of the air pocket layer.

2. The support device according to claim 1 comprising two air pocket layers, one on each surface of said open cell foam.

3. The support device according to claim 1 further comprising:
   - protective outer sheathing, and
   - a layer of adhesive between said sheathing and said air pocket layer, binding said sheathing to said air pocket layer.

4. The support device according to any one of claims 1 to 3 wherein said foam is from about $\frac{1}{8}$ to $\frac{1}{2}$ inch thick.

5. The support device according to any one of claims 1 to 3 wherein said foam comprises polyurethane foam.

6. The support device according to any one of claims 1 to 3 wherein said air pockets are from about $\frac{1}{8}$ to $\frac{1}{2}$ inch diameter.

7. The support device according to any one of claims 1 to 3 wherein said plastic film is from about 1 to 3 mils thick.

8. The support device according to claim 7 wherein the plastic film of at least one said air pocket layer comprises flexible poly-vinyl film.

9. The support device according to any one of claims 1 to 3 wherein said adhesive layer is from about 1 to 5 mils thick.

10. The support device according to claim 9 wherein said adhesive layer is a rubber-based latex adhesive with an organic solvent base.

11. The support device according to claim 3 wherein said sheathing comprises at least in part bias binding.

12. A support device resistant to bottoming out of laminar construction comprising:
   - a layer of flexible, open cell polyurethane foam;
   - a first air pocket layer adhered to one surface of said foam layer and a second air pocket layer adhered to the opposite surface of said foam layer, each comprising air pockets entrapped between flexible, impervious plastic film and said foam layer;
   - a first layer of adhesive binding said first air pocket layer to one side of said foam layer and a second layer of adhesive binding said second air pocket layer to the opposite side of said foam layer, said adhesive comprising pressure-sensitive, rubber-based latex adhesive;
   - protective outer sheathing over the surface of said first and second air pocket layers; and
   - a layer of adhesive binding said sheathing to the outer surface of each said air pocket layers, said adhesive comprising pressure-sensitive, rubber-based latex adhesive;
   - whereby, during use, the foam will conform to the surfaces of the air pocket layer.

13. A cushioned support innersole for footwear comprising a support device of laminar construction according to claim 1.

14. A cushioned support innersole for footwear comprising a support device of laminar construction according to claim 12.

* * * * *